United States Patent [19]

Burkemper

[11] 4,419,030

[45] Dec. 6, 1983

[54] APPARATUS FOR AND METHOD OF CONSTRUCTING A SHEET PILING SHORING STRUCTURE

[75] Inventor: Werner W. Burkemper, Manchester, Mo.

[73] Assignee: Burkemper Methods, Inc., St. Louis, Mo.

[21] Appl. No.: 302,073

[22] Filed: Sep. 14, 1981

[51] Int. Cl.[3] ..... E02D 5/02

[52] U.S. Cl. ..... 405/278; 405/274; 405/285; 405/232

[58] Field of Search ..... 405/274, 232, 276–279, 405/281, 285

[56] References Cited

U.S. PATENT DOCUMENTS

| | | | |
|---|---|---|---|
| 1,398,221 | 11/1921 | Boardman | 405/279 |
| 1,896,259 | 2/1933 | Thackray | 405/278 |
| 2,161,482 | 6/1939 | Miller et al. . | |
| 2,583,928 | 1/1952 | Caudill . | |
| 2,833,119 | 5/1958 | Molloy . | |
| 2,968,931 | 1/1961 | McGrath . | |
| 3,688,509 | 9/1972 | Van Weele . | |
| 4,028,901 | 6/1977 | Barber . | |
| 4,028,901 | 6/1977 | Barber | 405/277 |
| 4,083,192 | 4/1978 | Diekman . | |
| 4,172,681 | 10/1979 | Hache . | |
| 4,189,256 | 2/1980 | Dawson . | |

FOREIGN PATENT DOCUMENTS

| | | | |
|---|---|---|---|
| 1483188 | 8/1977 | United Kingdom | 405/278 |

OTHER PUBLICATIONS

Dawson Sheet Piling Brochure, Dawson Construction Plant Ltd,, England.

Barber/Foster Pile Threader Brochure, L. B. Foster Co., Houston, Tex.

Snorkelift TB50 Series Telescoping Boom Aerial Work Platform.

*Primary Examiner*—Dennis L. Taylor

*Assistant Examiner*—John A. Gungor

*Attorney, Agent, or Firm*—Polster, Polster and Lucchesi

[57] ABSTRACT

A system or apparatus for constructing a shoring structure of elongate, interlocking sheet piling members is disclosed which includes a workman support platform controllable by the workman thereon so as to position the workman near the upper end of a vertical piling member partially imbedded or "tacked" in the ground for guiding another piling member hoisted vertically thereabove into interlocking, threading engagement with the previously tacked piling member. A guide for aiding the alignment or threading of the interlocking piling members is disclosed. A method of constructing such a shoring structure is also disclosed.

14 Claims, 18 Drawing Figures

APPARATUS FOR AND METHOD OF CONSTRUCTING A SHEET PILING SHORING STRUCTURE

BACKGROUND OF THE INVENTION

This invention relates to a system of, apparatus for, and a method of constructing a shoring structure of interlocking sheet piling members which are to be driven into the ground, and, more specifically, to such a system, apparatus or method for positioning the interlocking piling members forming the walls of a cofferdam cell or other shoring structure. Still further, this invention relates to a guide for aiding in the threading of the interlocking sheet piling members.

Conventionally, a shoring structure, such as a cofferdam as may be used in the construction of bridge supports or dams, may utilize a series of circular or polygonal cells adjacent to or interconnected to one another. The cells are each formed by elongate sheet piling members having interlocking connections at their side edges with the sheet piling members driven into the earth to a considerable depth. A circular template may be initially positioned at a desired location for locating the cofferdam cell and for holding and guiding the sheet piling members as they are driven to form the circular cofferdam shell. The template is positioned on the interior of the cell to be formed and the piling members are aligned and guided by the template to maintain the cofferdam in a desired circular cross-section and of a desired dimension. Typically, a first piling member is positioned vertically against the template and is partially driven into the ground by a suitable pile driving apparatus. This partial driving of a sheet piling member is oftentimes referred to as "tacking". Then, a next sheet piling member is hoisted by a crane or other lifting apparatus so that the next piling member extends vertically and so that the bottom end of the next piling member is lifted somewhat above the upper end of the previously tacked piling member. The piling members typically have tongue and groove or other endwise slidable interlocking means extending along the full length of their side edges so that the piling members are securely interlocked together. The piling members may be moved longitudinally relative to one another. With the tongue and groove interlocked means of the previously tacked and the next piling member in sliding engagement with one another, the next piling member is lowered by the crane and is also tacked into the earth. Additional piling members are added to the cell following the form of the template so as to accurately position each of the piling members. Then, the tacked piling members are fully driven into the earth until the entire cofferdam cell is formed. After the shoring walls of the cofferdam cell are complete, the template is removed from the interior of the cell and, in some instances, the interior of the cell is filled with sand or other fill material so as to form a cofferdam. In other instances, the cell or shoring structure is used as a retaining wall and earth and water are removed from within the cell.

While a sheet piling cofferdam or other shoring structure may only be a temporary structure, the size and cost of constructing large cofferdams is immense. For example, in constructing a large dam and barge lock project in a river, a cellular piling cofferdam, a portion of which is shown in FIG. 1 of the drawings of the instant specification, may require 45 or more cells, each of which is about 65 feet (19.8 m.) in diameter and each containing approximately 165 sheet piling members, each of which is about 95 feet (28.9 m.) long with each of the piling members weighing approximately one and a half tons (1360 $^{k}$g).

Because the cells of a cofferdam project are often interconnected, it is generally necessary to construct each of the cells consecutively one after the other. Thus, only one cell at a time may be constructed. Conventionally, the piling members are manually interconnected by a workman, sometimes referred to as a staber, or a pile monkey, positioned on top of the last-tacked piling member. The staber usually stands in removable metal stirrups applied to the top edge of the last-tacked piling member and he straddles the last-tacked piling member. The staber then manually guides the next piling member which is to be interconnected with the previously tacked piling members while the next piling member is supported overhead by a hoist or crane. Oftentimes, the staber must be located some 60–90 feet above the level of the ground (or water) while he is guiding the piling members into interlocking engagement. As previously mentioned, the next piling member to be interlocked is hoisted lengthwise by a crane so that its bottom edge is above the level of the last partially tacked piling member. While the next piling member is so hoisted by the crane, the staber must manually grasp the next piling member, turn it to correctly orient the interconnecting means along the edges of the piling members, and instruct the crane operator (usually by hand signals) how to lift, lower, or laterally move the hoisted piling member so that it can be guided into interlocking relation with the previously tacked piling member. However, due to the extreme length of the hoisted piling member, to the lack of a good working position as the staber straddles the upper edge of the previously tacked piling members while standing in the stirrups, to the great weight (and hence inertia) of the suspended piling member, and due to any wind that may be blowing, the staber's job of interconnecting the piling members is difficult, time consuming, and dangerous. If, upon sliding the interconnected piling members relative to one another, the piling members hang up, it is sometimes necessary for the staber to be lowered on a crane hook to the elevation to the level where the piling members are hung up in an effort to free the member. Of course, the lowering of the staber on the crane hook may, in some instances, be hazardous.

Because the job of interconnecting the piling members is dependent on ideal weather conditions, the sticking of the piling members cannot safely be carried out on windy days, even though the weather would be perfectly acceptable for other construction work. Thus, cofferdam construction jobs may be even more adversely affected by weather conditions than other types of construction. Accordingly, the cost of such cofferdam construction jobs are exceedingly difficult to accurately estimate and schedules for the completion of the cofferdam construction are difficult to meet.

As heretofore mentioned, the staber is supported on the upper edges of the previously tacked piling member some 60–90 feet above the level of the ground or the water. The staber is supported by removable stirrups engageable with the upper edges of the previously tacked piling members. As the adjacent piling members are interconnected and tacked, the staber must move the stirrups from one piling member to the next piling member. While these stirrups are, in effect, a safety support for the staber, they do not provide a stable and secure work platform. With the staber's legs straddling the ends of the tacked piling members, it is sometimes difficult for the staber to exert sufficient force on the hoisted piling member so as to jockey it into position for alignment with the interconnecting means. Also, in some instances, it is necessary for the staber to reach out for the piling member being hoisted. The stirrups do not permit the staber to move appreciable distances away from the stirrups and overreaching can cause the staber to lose his footing or balance. Additionally, the staber must, in many cases, ride on the hook of the crane so as to be lifted to or plucked from his tacking position on top the last-tacked piling members. This practice of riding the crane hook is sometimes dangerous. Still further, some staber's find it uncomfortable to remain standing in the stirrups or to sit on the relatively narrow upper edges of the previously tacked sheet piling members for any length of time. Thus, oftentimes the staber will need to be lifted down for a rest period and this even further impedes or slows down the positioning of additional piling members.

In an effort to provide a better work station for the staber, cofferdam contractors have utilized a wheel mounted hydraulic lift incorporating a telescopic boom with a workman support gasket thereon. These work supports are sometimes called "cherry picker" lifts. While these wheel mounted lifts did result in a more satisfactory support for the workman, they require that a special support platform be provided on the inside of the shoring structure, or that the wheel mounted lift be supported on the ground within the walls of the cellular shoring structure being constructed or on a barge.

In an effort to eliminate many of the problems and dangers of positioning a workman on the top of the previously tacked piling members, a variety of piling guides have been proposed, but, in general, these prior art piling guides have not met with widespread commercial acceptance. Certain of these piling guides are utilized by attaching the guide to the free side of a tacked piling member a few feet above the level of the ground. Then, the next piling member is lifted vertically and swung into place so as to be generally alongside of the previously tacked piling member and so that its lower edge is at the approximate elevation of the guide attached to the previously tacked piling member. Then, the next piling member is secured to the guide and the next piling member together with the guide is hoisted to a level until the guide is at the upper end of the last-tacked piling member and such that the bottom end of the next piling member is positioned somewhat above the upper edge of the last-tacked piling member. With the piling members in this position, a workman on the ground pulls a lanyard so as to actuate the guide and to move the hoisted piling member laterally thereby to axially align the interlocking means of the hoisted piling member with the previously tacked piling member. The crane operator then lowers the hoisted piling member and the interlocking means of the piling members are then endwise threadably engaged thus permitting the hoisted piling member to be lowered and to be tacked into the earth. When the next piling member is lowered down to a convenient working height, a workman on the ground then removes the guide and the next piling member is partially driven or tacked into the ground.

The above-described prior art piling guides have been intended primarily for the purpose of eliminating the necessity of a staber positioned on the top of the previously tacked piling members. However, in actual practice, difficulties have been encountered in making threading engagement between the interlocking means of the piling members. For example, the crane hoisting the next piling member may be supported on a floating barge and wave action may cause the crane and the hoisted pile to overrun or overshoot axial alignment thus making the threading difficult. Also, in driving piles, pile members of different lengths are sometimes used. After the different length pile members are tacked, shorter lengths of pile are added to make all piles the same height. However, these pile threaders cannot be used in aligning these shorter, fill-in piles. Still further, others of these pile threading devices are complicated pnuematic or hydraulic units of extreme complexity and weight.

Reference may be made to such U.S. patents to the following disclosing prior art sheet piling alignment and guide systems and sheet piling alignment apparatus in the same general field as the present invention: U.S. Pat. Nos. 2,161,428, 2,583,928, 2,833,119, 2,968,931, 3,688,509, 4,028,901, 4,083,192, 4,172,681 and 4,189,256.

SUMMARY OF THE PRESENT INVENTION

Among the several objects and features of the present invention may be noted the provision of a system or apparatus for constructing sheet piling shoring structure in which a workman may be readily and relatively safely positioned on a work platform adjacent the top of a previously tacked piling member so as to enable the workman to conveniently and rapidly guide the next piling member into endwise interlocking position with the previously tacked piling member;

The provision of such a system or apparatus in which the workman may readily position himself in the most advantageous work position so as to aid in the interconnection of the piling members without reliance on other workmen;

The provision of such a system or apparatus in which the workman is not supported by the previously positioned piling members;

The provision of such a system or apparatus in which the workman need not accurately position the hoisted piling member relative to the previously tacked piling member as the piling members are threaded in endwise interconnected relation;

The provision of such a system which is capable of use in weather (e.g., wind conditions) which would preclude the construction of such sheet piling shoring systems utilizing a pile staber positioned on the top edge of the last-tacked piling members;

The provision of such a system which is adaptable to a variety of cofferdam and other shoring structure configurations and which does not take substantial setup or teardown time;

The provision of such a system or apparatus which does not require special work surfaces or barges for supporting the work station apparatus;

The provision of such a system in which the workman may readily move horizontally relative to the top of the piling member so as to permit the use of a "hairpin" pile driving weight thereby to aid in the sliding interconnection and tacking of the piling member;

The provision of a guide for use in the endwise interconnection of sheet piling members which has no moving parts and which may be readily positioned on the piling member so as to align and interconnect a piling member with a previously tacked piling member;

The provision of a single piling guide which may be used to guide into position all of the piling members of a shoring structure, even when the sheet piling members require alternate placement of the piling members with one piling member having one face thereof facing inwardly and with the next adjacent identical piling member having that same face facing outwardly;

The provision of such a guide which is easy to use, which is of simple, economical, and rugged construction, which is light in weight, and which markedly facilitates and speeds-up the interconnecting of the sheet piling members; and The provision of a method of constructing a sheet piling shoring structure which is appreciably faster and more productive than previous construction methods.

Briefly stated, the system of this invention relates to the construction of a shoring structure having a substantially vertical wall formed of a plurality of interlocked, elongate piling members driven into the ground with each of the piling members having means along its sides for interconnection with adjacent piling members. The shoring structure is constructed by positioning at least one of the piling members generally vertically and by at least partially imbedding this one piling member into the ground. Then, a next piling member is hoisted above the upper end of the one vertical piling member and the interconnection means of the one piling member and the hoisted piling member are engaged and the hoisted piling member is lowered relative to the one piling member and it is at least partially driven into the ground. Specifically, the invention of this system comprises apparatus for supporting a workman at a desired position adjacent the upper end of the one piling member so as to enable him to guide the hoisted piling member into endwise, interlocking relation with the one piling member. The workman support includes a base, a boom coupled to the base and extending upwardly therefrom, a workman support platform carried by the outer end of the boom. The boom includes means for selectively positioning the workman support platform proximate the upper end of the partially imbedded piling members thereby to enable the workman to aid in the interconnection of the piling members.

The present invention further comprises a guide for aiding the vertical threading of a piling member to another vertical piling member which is at least partially driven or imbedded into the ground, each of the piling members having interlocking means along the lateral edges thereof and extending the length thereof with the interlocking means of one of the piling members being adapted to receive the interlocking means of the next adjacent piling means when the interlocking means of the piling members are endwise threaded together. The piling members are slidable lengthwise relative to one another upon threading of the interlocking means thereof together. The guide of the present invention has a body with a blind slot in one side thereof extending from one end of the guide body and terminating a distance from this one end of the guide body, this blind slot being adapted to receive a portion of the upper end of the at least partially driven piling member thereby to align the guide body with the longitudinal axis of the interlocking means of the at least partially driven piling member. The guide body further has a guide opening extending therethrough with the guide body having a slot extending longitudinally through the guide body on the side of the guide body opposite from the above-mentioned blind slot for providing communication between the other side of the guide body and the guide bore and for receiving a portion of the lower end of the next adjacent piling member and for aligning the interconnecting means of the next adjacent piling member to the interconnecting means of the at least partially driven piling member so that upon lowering the next piling member, the interlocking means of the piling members will be endwise threaded together.

The method of the present invention of constructing a shoring structure from elongate piling members, as heretofore described, consists of the steps of at least partially inserting one end of a first piling member into the ground and then positioning a workman on a selectively movable work platform adjacent the upper end of this first piling member. Then, a piling guide is installed on the upper end of the first piling member and a second piling member is hoisted above the level of the guide with the second piling member extending vertically. The second piling member is lowered and is guided into the guide thereby to facilitate the alignment of the interconnecting means of the first and second piling members into endwise threaded engagement with one another. The second piling member is lowered with respect to the first piling member and is at least partially imbedded into the ground.

Other objects and features of this invention will be in part pointed out and in part apparent hereinafter.

BRIEF DESCRIPTION OF THE DRAWINGS

Corresponding reference characters indicate corresponding parts throughout the several view of the drawings.

DESCRIPTION OF PREFERRED EMBODIMENTS

Figure 1:
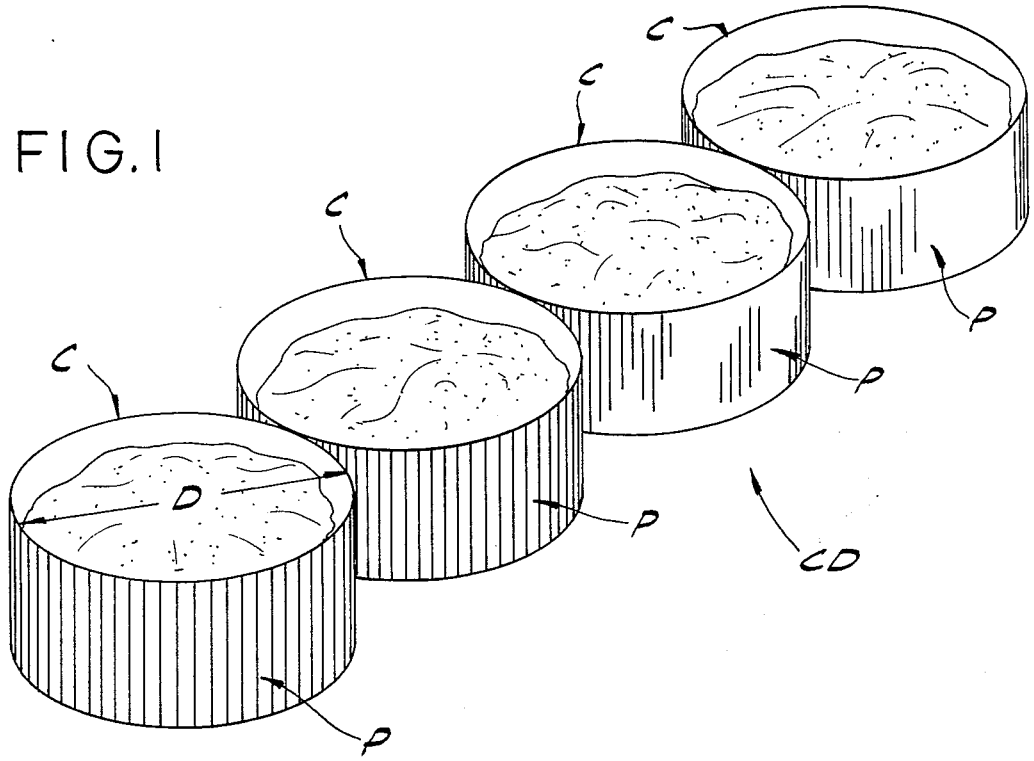
FIG. 1 is a perspective view of a shoring structure, such as a cofferdam, consisting of a plurality of circular cells formed of interlocking, vertical, sheet piling members driven into the earth with the cells in close proximity to one another and with the cells filled with a suitable filler material (e.g., sand or the like)

Referring now to the drawings, and particularly to FIGS. 1–4B, a cofferdam structure, as generally indicated at CD, is shown in FIG. 1 to comprise a plurality of shoring structures or cells C interconnected or spaced closely to one another to form a wall of a cofferdam. For example, such a cofferdam arrangement may be constructed out into a river in generally rectangular fashion to block off a portion of the river in which the tainter gates of a lock and dam system may be constructed. Upon completion of the construction, the cofferdam system is removed.

Typically, each of the shoring structures or cells, as shown in FIG. 1, is a cylindrical structure made of a plurality of sheet piling members P interlocked with one another along their adjacent lateral sides and driven into the earth or ground by a suitable pile driving apparatus (not shown). After the sheet piling members have been placed in circular arrangement shown, and driven into the ground a desired amount, the cells may be filled with a suitable fill material (e.g., sand) to form the cofferdam. While the cofferdam itself may be only a temporary structure to facilitate construction of a dam or bridge abutment, the construction of the cofferdam may be a major construction project. For example, a large cofferdam project may require the use of some 45 cells so as to extend 1,000 feet (305 m.) out into a river, and 800 feet (244 m.) downstream. Each of the cells C may require 160 or so sheet piling members P and may have a diameter D of 60 or more feet (18.3 m.).

Figure 3:
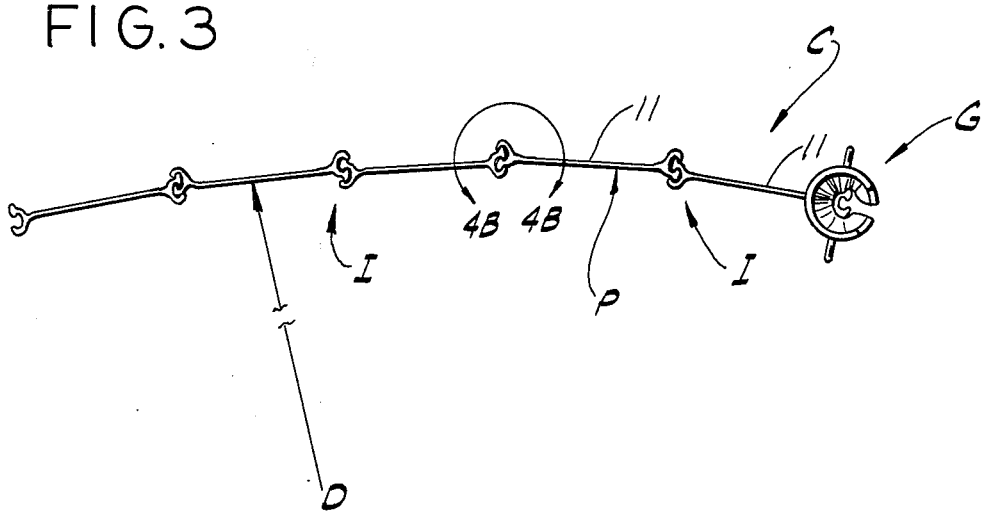
FIG. 3 is a plan view of a section of a shoring structure taken along line 3—3 of FIG. 2A on an enlarged scale showing the interlocking sheet piling members and the guide.
Figure 4A:
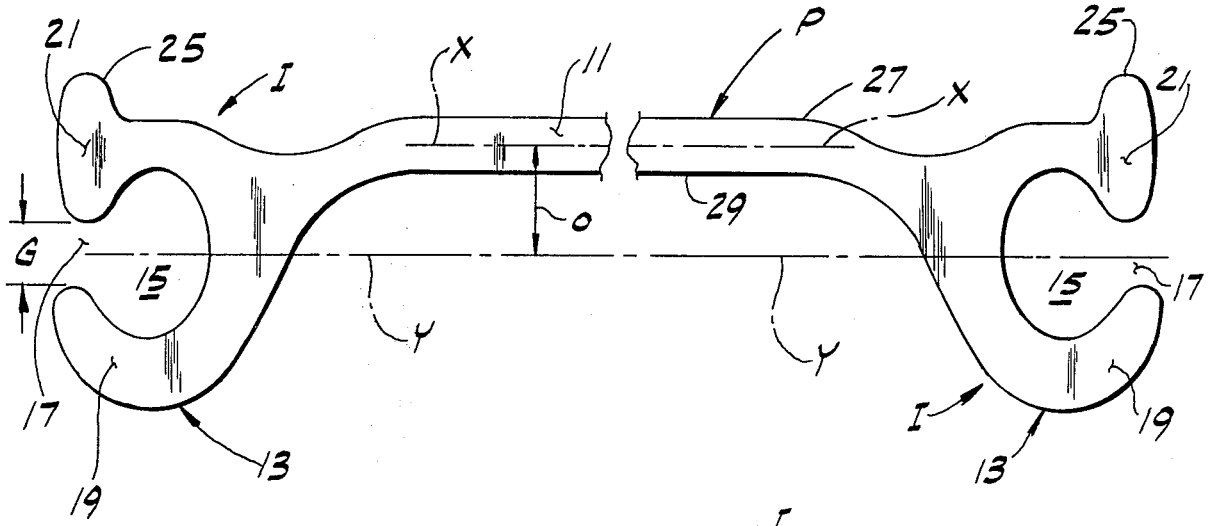
FIG. 4A is an enlarged end or cross-sectional view of a typical sheeting piling member illustrating the interlocking means at the side edges of the piling member.
Figure 4B:
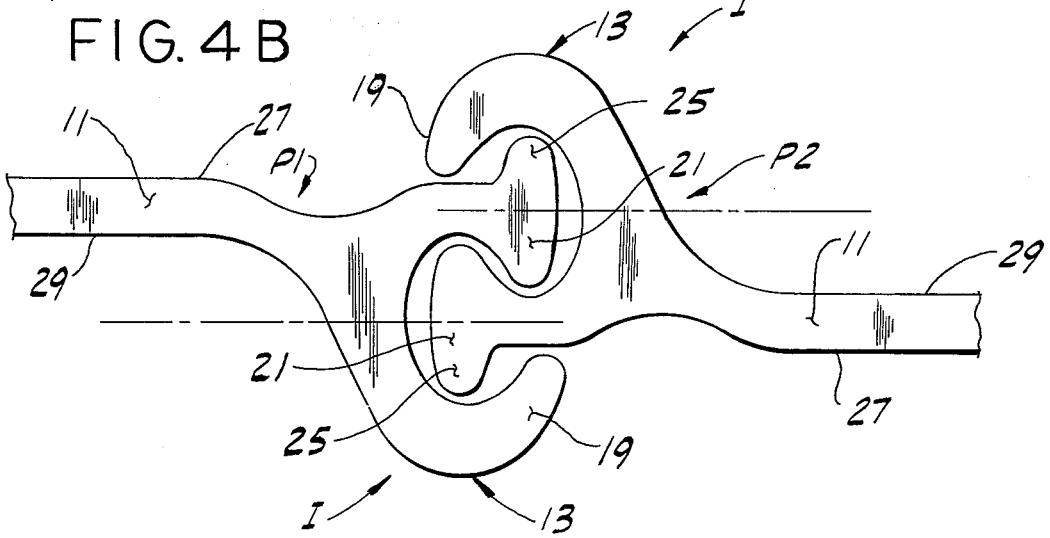
FIG. 4B is a view taken on line 4B—4B of FIG. 3 in enlarged scale illustrating two adjacent sheet piling members in interlocking relationship.

Turning to FIGS. 3–4B, a cross-sectional or end view of a typical sheet piling member P is illustrated. Typically, a sheet piling member P is rolled from sheet steel and has a width ranging between about 12 and 20 inches (30 and 51 cm.). The piling member has a web 11 which may, for example, have a thickness of approximately 0.375 inches (9.5 mm.), and may weigh anywhere from 30–40 pounds or more per linear foot (44.5–59.6 $^{k}$g/m.) of the pile member. In many applications, the piling members may range up to a 100 feet (30.5 m.) in length and thus each piling member may weigh 4,000 pounds (1816 $^{k}$g) or more.

Additionally, each of the piling members has interlocking means, as generally indicated at I, at each lateral side thereof for endwise interlocking relationship with the next adjacent piling member so that the piling members, with their interlocking means inserted endwise into one another, form a continuous shoring wall.

Figure 5:
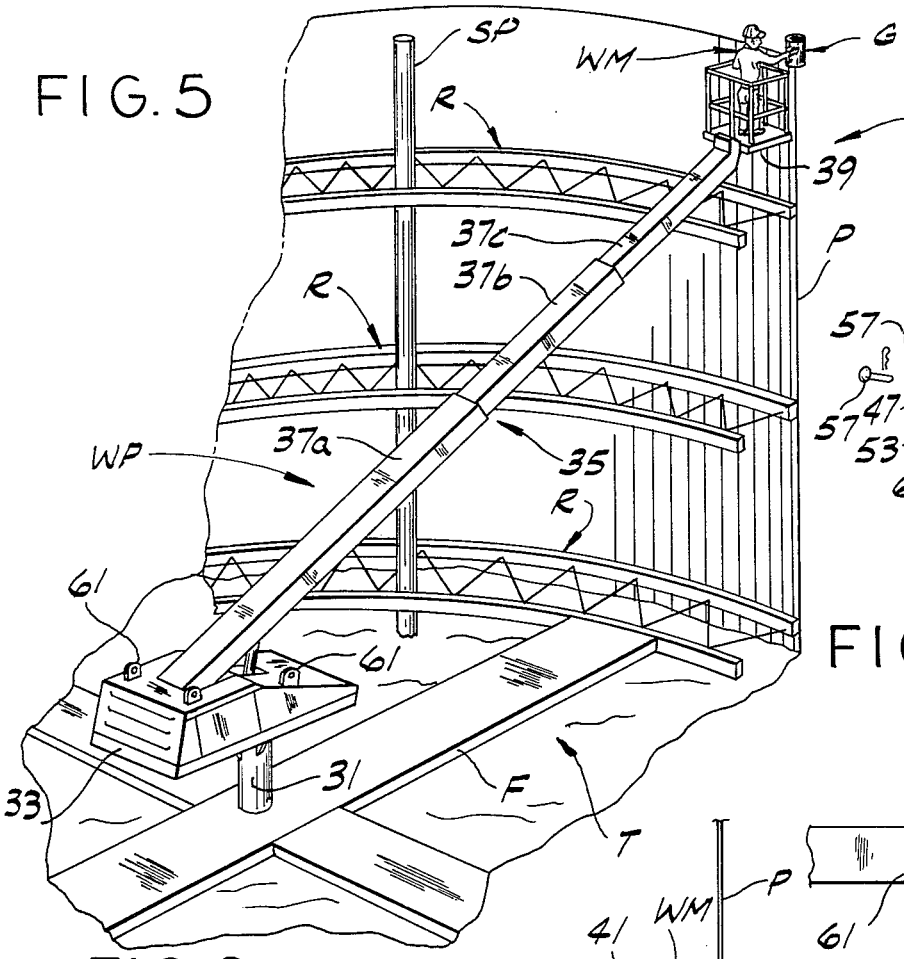
FIG. 5 is a perspective view of a portion of a shoring structure, such as a cofferdam cell under construction, having a template positioned therewithin for locating and aligning the piling members and further illustrating a work platform support appratus of the present invention incorporated in the template with a workman supported on the work platform in position for aiding in the alignment of the interlocking means of the sheet piling members.
Figure 6A:
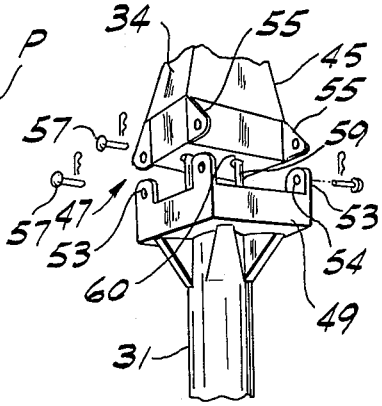
FIG. 6A is a perspective view of means for removably securing the workman support platform apparatus on the spud pile.
Figure 7:
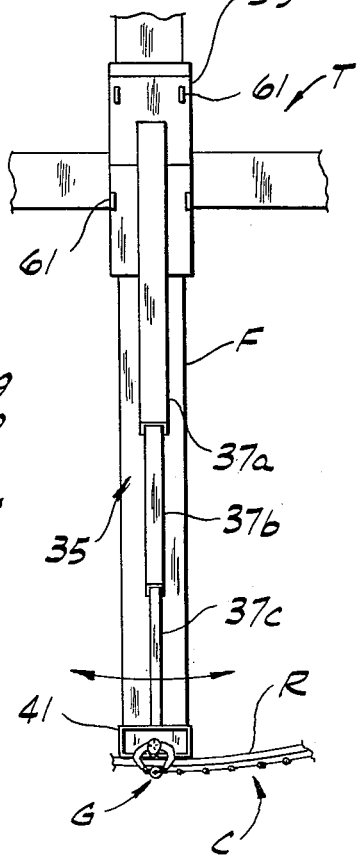
FIG. 7 is a top plan view of the apparatus shown in FIGS. 5 and 6.
Figure 6:
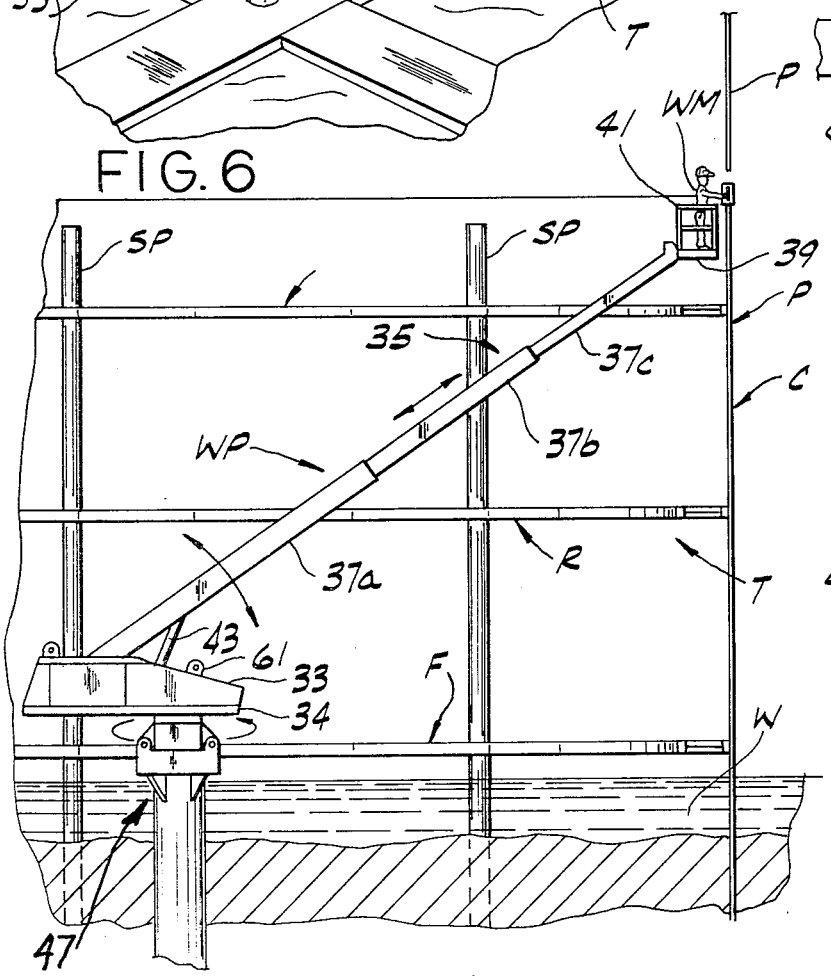
FIG. 6 is a side elevational view of the shoring structure and the workman support platform illustrated in FIG. 5 with the work pltform support apparatus being shown to be readily removably mounted on a central spud pile driven into the earth for the dual purpose of supporting the template and also for supporting the work platform apparatus.

As shown in FIGS. 5–7, a template, as generally indicated at T, is located at a position in which the shoring cell C is to be located. The template T includes a plurality of circular rings R spaced vertically from one another and supported by means of spud piles SP. The rings are of the desired diameter of the cell to be constructed and serve as a guide for the alignment and positioning of the piling members P as they are driven into the earth. A more detailed description of the use and the construction of the template will be described hereinafter.

Figure 2A:
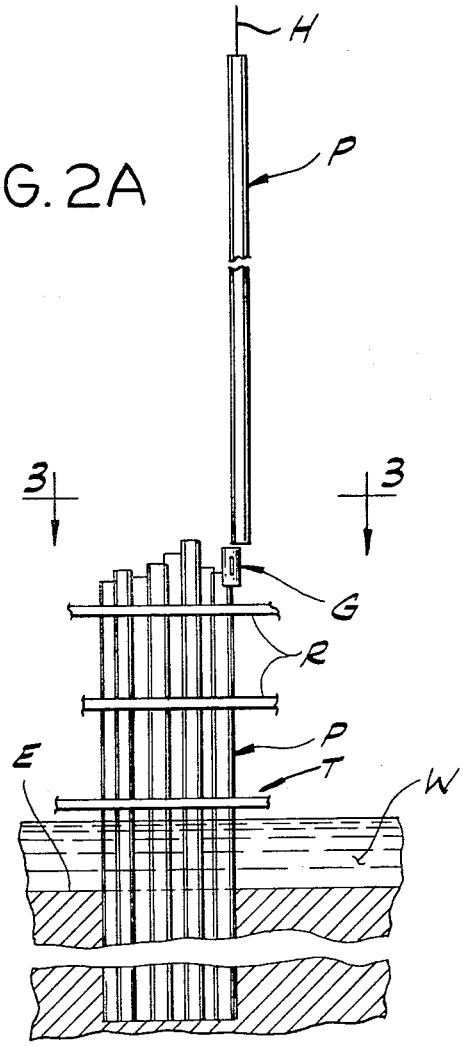
FIG. 2A is a side elevational view of a number of elongate sheet piling members oriented generally vertically extending down into the water and partially imbedded or tacked in the earth so as to be maintained in their desired vertical position and further illustrating a next sheet piling member hoisted above the upper ends of the tacked piling members and being positioned relative to a sheet piling guide of the present invention for alignment of the interlocking means at the side edges of the sheet piling members.
Figure 2B:
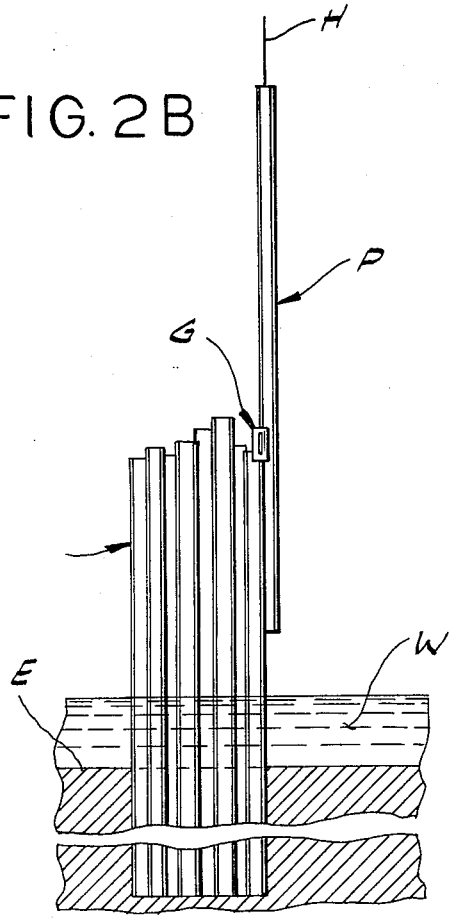
FIG. 2B is a view similar to FIG. 2A with the interlocking means of the last-tacked sheet piling member and the next sheet piling member threaded in endwise interlocking engagement and with the last-mentioned sheet piling member being lowered for being tacked or partially driven in the earth.

Referring to FIGS. 2A and 2B, a first piling member P is hoisted vertically, and positioned adjacent the rings R of template T and lowered until its lower end extends down through the water W into the earth E and is at least partially driven into the earth by a suitable pile driver (not shown). This operation is oftentimes referred to as tacking the pile member. As shown in FIGS. 2A and 2B, a first series of piling members is interconnected to one another and are tacked in the earth. The next piling member to be tacked is hoisted vertically, as shown in FIG. 2A, by a suitable crane or hoist H by one end to an elevation wherein the lower end of the hoisted piling member is above the upper end of the tacked piling members.

In accordance with this invention, a piling guide, as generally indicated at G, is installed on the upper end of the last-tacked piling member and the lower end of the next piling member is lowered by hoist H into piling guide G so as to align the interlocking means I of the last-tacked piling member and the next adjacent piling member in endwise interlocking alignment with one another. Then, the next piling member is lowered by hoist H relative to the previously tacked piling members (as shown in FIG. 2B) with the interlocking means of the two piling members interlocked with one another so as to permit longitudinal sliding movement between the two piling members. As the lower end of the last placed piling member comes into engagement with the earth E, it too is partially driven or tacked. It will be understood that as the piling members are being interlocked and tacked in the manner described above, that the previously tacked piling members may be at least temporarily secured to the rings R of template T thereby to hold the piling members in a desired vertical and circular shape conforming to the template. After a number of piling members have been tacked, the piling members may be driven into the earth to a desired depth sufficient to securely anchor and seal the shoring structure. The depth to which the piling members are driven will vary from job-to-job but, for example, they may be driven 30 feet (9 m.) or more into the earth. It will be appreciated that if the piling members are approximately 100 feet in length, and if they are driven 30 feet (9 m.) or more into the earth, that they may extend above the level of the earth E and water W to a considerable height (e.g., 40–60 feet, 12–18 m.).

Referring now to FIGS. 3–4B, each piling member P has a bulbous, C-shaped flange 13 extending along the entire lateral sides or margins of web 11 constituting interlocking means I. Each of these bulbous flanges has a groove 15 therein extending the full length of the piling member. Groove 15 is generally C-shaped and has a relatively narrow opening 17 with the throat of the opening being indicated by dimension G in FIG. 4A, throat G being of considerably less width than the width of opening 15. Bulbous flange 13 further includes a first jaw portion or finger 19 and a second jaw portion or thumb 21 with these jaw portions being spaced apart by the dimension G and forming the opening 17. A shoulder 25 is integral with the second jaw 21.

Referring now to FIG. 4B, it will be seen that if the interlocking means I of two of the piling members P are threaded endwise relative to one another, the second jaw or thumb 21 together with the shoulder 25 of one of the piling members (as indicated by P1 in FIG. 4B) is insertable endwise and received in the longitudinal groove 15 of the other piling member P2, that a portion of jaw 21 of piling member P1 extends out through gap 17 of piling member P2, and that the second jaw 21 and shoulder 25 of piling member P2 is received within the opening 15 of the first piling member P1. The first jaws 19 of each of the piling members is on the outside of the second jaw 21 of the other piling member and thus, in this manner, the piling members are positively interconnected or interlocked with one another along the entire length, but yet the piling members are slidable relative to one another in vertical direction. It will be further appreciated that the construction of the interlocking means is such that the piling members cannot be appreciably moved laterally with respect to one another.

Still referring to FIGS. 4A and 4B, it will be seen that the particular piling member P illustrated therein is not symmetrical about a lateral axis, but rather the central plane of web 11, as indicated by axis X—X, is offset by a distance O from a central plane Y—Y passing laterally through the centers of openings 17 at either side of the piling member. Additionally, one face of web 11 is shown to be indicated by reference character 27 and the other side of the web is indicated at 29. With the particular construction of the piling member P shown in FIG. 4A, it will be appreciated that with the piling members joined together in the manner shown in FIG. 3 to form a vertical wall of a shoring structure or cell C the piling members must alternate with one another so that one of the piling members (the left-hand piling member P as shown in FIG. 4B) is oriented with its first side 27 facing outwardly and such that the next adjacent piling member (i.e., the piling members P2 both to the left and the right) of this first piling member are oriented with their face 27 facing inwardly so that interlocking means I of each of the next adjacent piling members cooperate with one another in the manner shown in FIG. 4B.

It will be appreciated that the piling member described and illustrated in FIGS. 3–4B is only one example of any number of proprietery designs for piling members commercially available from steel manufacturers and fabricators. While the sheet piling member P illustrated in FIG. 4A is of generally a flat construction, the piling members may be channel-shaped or Z-shaped. Additionally, the interlocking means I, rather than comprising identical C-shaped bulbous forms at the lateral sides of the piling member, may constitute such a bulbous C-shaped form at one lateral side and a tongue (not shown) at the other side which is received in the C-shaped opening of an adjacent piling member so as to form an interlocking tongue and groove coupling arrangement. Still further, it will be appreciated while the shoring structure C illustrated in the drawings of the present disclosure is shown to be of circular cross-section, the system, apparatus, and method of the present invention may be utilized to construct shoring structures of any desired cross-sectional shape including rectangular, square, planar, or oval-shaped shoring structures.

Referring now to FIGS. 5–7, a system or apparatus for aiding a workman WM guiding the next piling member into interlocking relation with the previously tacked piling member is indicated in its entirety by WP. As best shown in FIG. 5, piling member template T is comprised of a plurality of vertically spaced rings R supported relative to one another by spud piles SP so as to be generally concentric with one another thereby to hold the piling members P in desired vertical and concentric alignment relative to the center of the circular cell C being formed. These template rings R are relatively lightweight rings (for their size) of truss-like construction and are supported on a plurality of spud piles SP driven into the earth E around the circumference of the rings. Additionally, a spider frame, as indicated at F, may be provided in conjunction with the lower ring after the template rings have been installed on the spud piles SP with the spider frame radiating outwardly from a central spud pile 31 which is driven into the earth a suitable distance. As is shown in FIG. 6, spud pile 31 may extend down through water W and be driven into the river or lake bed at a desired position to locate the template relative to other shoring structures.

Work platform/hoist WP is shown to be a self-powered telescopic boom aerial work platform. The work platform includes a turret 33 rotatably mounted on a base 34 for rotation about a vertical axis generally concentric with the longitudinal axis of spud pile 31. Further, a telescopic boom 35 is mounted on the turret with the boom including telescoping boom extensions **37*a*, 37*b*, and 37*c*. A work platform 39 is cantilevered from the end of the telescopic boom and the work platform is of adequate size to comfortably and safely support a workman WM while he is positioning and guiding piling members P into interlocking engagement with one another. Work platform 39 is shown to have a safety rail 41 therearound. Boom 35 is raised and lowered by means of a hydraulic cylinder unit 43 and the telescopic boom includes telescopic hydraulic cylinder units and pulley and cable arrangements enclosed within the boom for extending and retracting the boom. Thus, by extending and retracting the boom to a desired length, by raising and lowering the boom via hydraulic cylinder unit 43**, and by rotating the turret about vertical axis, the work platform may be readily moved to any desired position to enable the workman WM to advantageously position himself to guide the piling members in interlocking relationship.

For example, such telescoping boom aerial work platforms WP, as illustrated in FIGS. 5–7, are commercially available from the Snorkel Division of ATO, Inc. of St. Joseph, Mo. As is typical, these work platforms include hydraulic controls on the work platform 39 operable by workman WM standing on the work platform so that he has complete control over the platform, boom and turret while he is on his working platform. It will be appreciated that the work platform 39 is mounted to the end of boom section 37*C* in such manner that it is maintained in horizontal position at all times.

It will be understood that by providing such a telescopic boom aerial work platform WP, the workman WM may be safely and comfortably supported in any desired position adjacent the top of the previously tacked piling members P and may comfortably stand on the work platform 39 relatively long periods of time to facilitate the placement and tacking of a number of piling members P. In addition, the work platform 39 is of sufficient size and weight carrying capability that not only the workman, but a number of tools useful to the workman may also readily be carried by the work platform. It will further be appreciated that by using the work platform WP, the need for the workmen to straddle the upper edges of the previously tacked piling members on removable stirrups is eliminated. Because the workman is more stably and safely supported on the work platform 39, and because he is not as liable to be knocked off balance by the hoisted piling members, tacking of the piling members may be conducted in weather which was heretofore too windy to tack the piling members using prior art construction methods. Also, because the work platform 39 may be readily raised and lowered to ground level, the use of the hoist WP eliminates the necessity of the workman having to ride on crane hooks or the like to be positioned on top of the previously tacked piling members.

Also, because the work platform 39 may be selectively moved in vertical direction along the full height of piling members P, the workman WM may readily move to any desired position along the cell C being constructed to aid in tacking or driving the piles. Also, the workman may be readily supported on the work platform in a safe position if, for example, a hairpin driver must be used to tack the piling members. Further, it will be appreciated that while the telescopic boom aerial work platform WP was shown to be a hydraulic unit, less expensive units which are hand powered using cable and pulley arrangements may also be utilized.

In accordance with this invention, the work platform/hoist WP is mounted for quick attachment to and removal from spud pile 31. This quick attachment means is generally indicated at 47 and is shown to comprise a base 49 on the upper end of support pile 31. As shown in FIG. 6A, the base is provided with a number of spaced tangs 53 having bolt holes 54 therethrough and ears 55 are provided on the bottom of turret base 45 to receive tangs 53. With the ears 55 received on their respective tangs 53, pins 57 may be inserted through the respective holes 54 therein thereby to positively interconnect the work platform to the spud pile. To aid in alignment of turret base 45 to spud pile head 49, a plurality of vertical guide pins 59 is provided projecting up from the head 49 to be received in respective tapered guide holes 60 in the bottom of base 45. Additionally, tangs 61 may be provided on turret 33 to which a lifting sling or the like (not shown) may be attached so that crane or hoist H may be utilized to readily lift the work platform/hoist WP into position. Hoist H may also be used to lift template T as a unit. In this manner, the template T and the work platform/hoist WP may be readily moved from one position to the next so as to rapidly and efficiently construct the shoring cells C.

Figure 8:
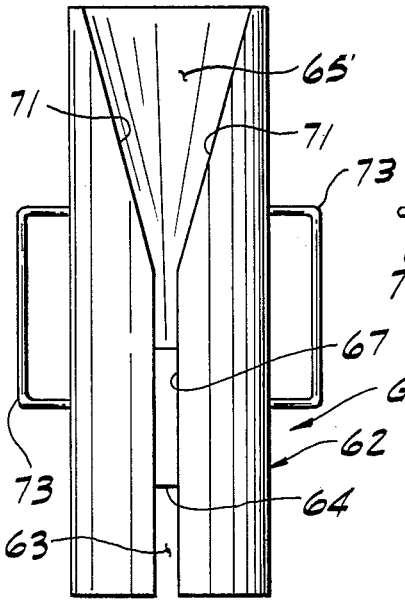
FIG. 8 is a front elevational view of a first embodiment of a sheet piling guide of the present invention.
Figure 9:
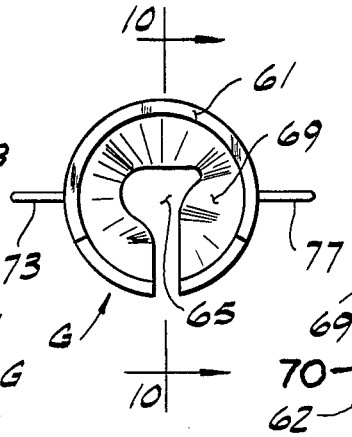
FIG. 9 is a top plan view of the sheet piling guide illustrated in FIG. 8.
Figure 10:
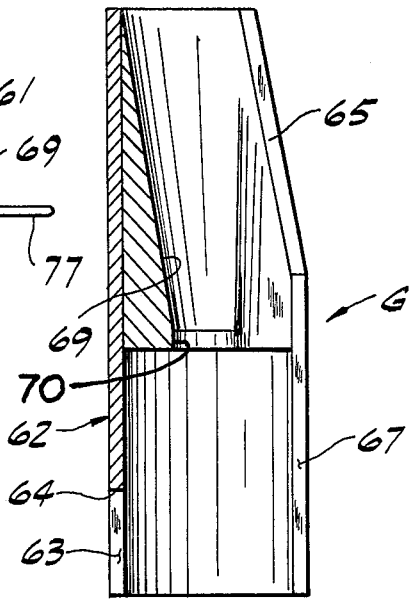
FIG. 10 is a longitudinal cross-sectional view taken along line 10—10 of FIG. 9 illustrating details of the sheet piling guide.

Referring now to FIGS. 8–10, a first embodiment of a piling guide G of the present is illustrated. This piling guide is shown to have an elongate, tubular guide body 62 having a blind slot 63 at one side thereof at its lower end with the inner end of the blind slot constituting an abutment surface 64. The guide body further has a guide bore 65 extending longitudinally therethrough from the upper to the lower end of the guide body. The guide body is further provided with a longitudinal slot 67 on the side of the guide body opposite from blind slot 63. The guide body has tapered transition ramps or guides 69 on its interior tapering inwardly from the open upper end of the guide body to a guide throat 70 having the general profile of the exterior configuration of one end of a piling member P to be inserted into endwise interlocking engagement with another piling member. Additionally, the guide body has converging guide ramps 71 extending downwardly and inwardly from the upper end of the guide body toward longitudinal slot 67. The width of the longitudinal slot 67 is somewhat wider than the width of web 11 of the piling member P to be guided into position. Guide G is further provided with handles 73 (see FIG. 8) on opposite sides thereof to facilitate handling of the guide by workman WM standing on the support platform 39. It will further be appreciated that safety tie ropes (not shown) may be secured to handles 73 and to the work platform (or to the previously tacked piling members) to prevent the guide from inadvertently being dropped and possibly injuring a workman standing below the work platform.

Preferably, guide G may be cast from a suitable metal alloy so that the guide ramps 69 have a generally smooth transition from the open circular upper end of the guide member to the guide throat 70 configured conform to the shape of the bulbous flange interconnecting flange 13 of the piling members P. While it is desirable that the guide G be constructed of a suitable metal alloy so as to withstand the forces that may be applied thereto by the piling members as they are lowered into position and as they are guided into interlocking relationship, it is preferred that the guide G be fabricated of a suitable metal. For example, the guide may be cast of aluminum and may have hardened steel wear surfaces installed therein to constitute guide ramps 69 thereby to withstand the wear and tear of guiding heavy piling members into interlocking relationship. Alternatively, the piling guide may be fabricated from a section of steel pipe and having guide ramps 69 welded-in-place to form guide throat 70.

Figure 11:
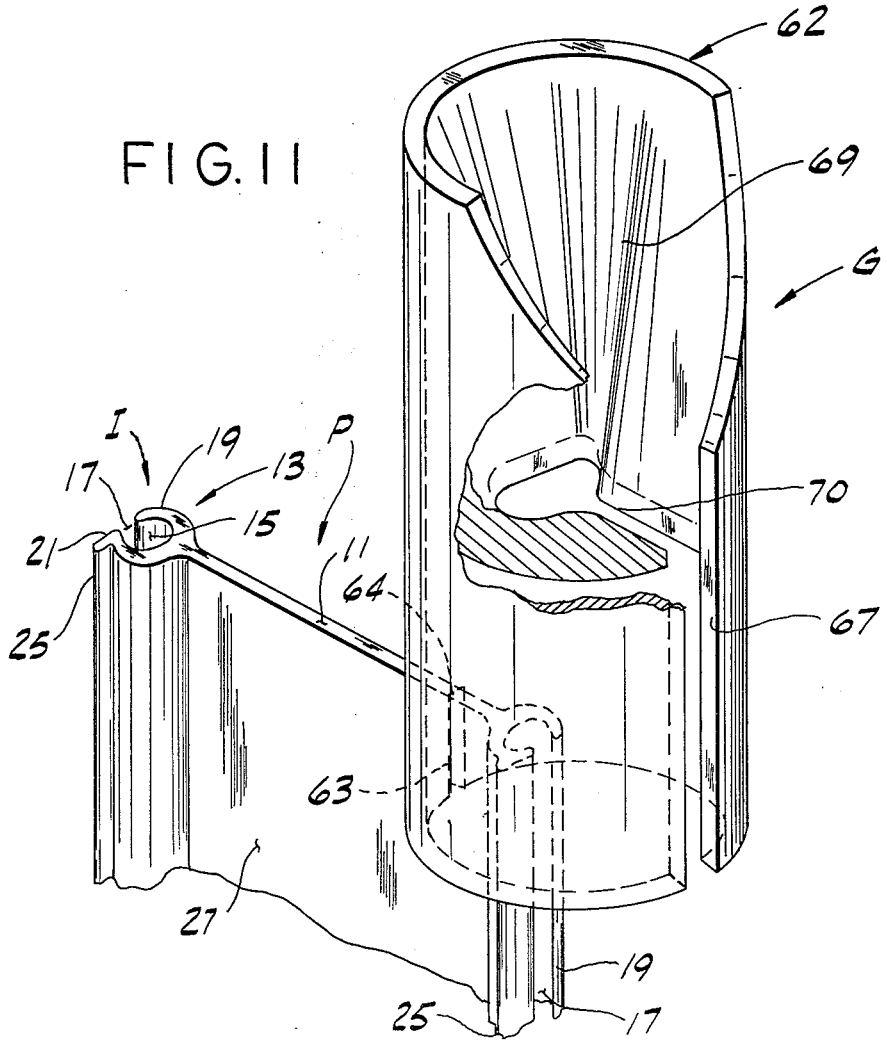
FIG. 11 is an enlarged scale perspective view of the sheet piling guide shown in FIGS. 8–10 mounted on the upper edge of a previously tacked sheet piling member for reception of and for alignment of the interlocking means of the next piling member in endwise interlocking relation with the interlocking means of the tacked piling member.
Figure 12:
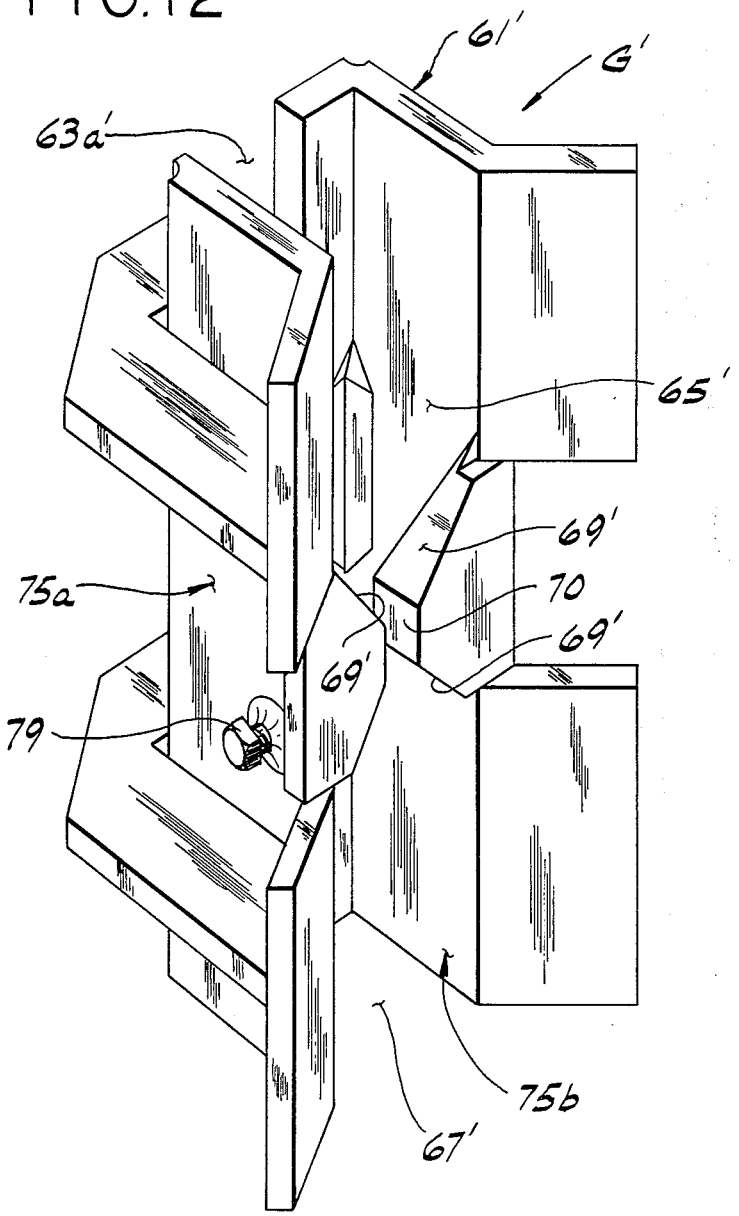
FIG. 12 is a perspective view of a second embodiment of a sheet piling guide of the present invention.

As illustrated in FIG. 11, guide member G is installed on the upper end of a previously tacked piling member P at the outermost lateral side thereof (the right-hand side of the piling member as shown in FIG. 11) with the web 11 of the previously tacked piling member being received in blind slot 63 and with the upper edge of the web bearing against abutment surface 64 of the blind slot. With guide G positioned as shown in FIG. 11, the center of opening 15 in the C-shaped interconnecting member at the right-hand side of piling member P is in general axial alignment with the center of the guide throat 70 in guide bore 65 of the guide body. Then, the next piling member to be tacked is hoisted above guide G, as shown in FIG. 2A, and is oriented so that its flange 25 faces in opposite direction from flange 25 of piling member P shown in FIG. 11 so that the interconnecting means I of the two piling members may be endwise interconnected, as shown in FIG. 4B. Workman WM standing on work platform 39 manually grasps the lower end of the piling member P which has been hoisted above the upper end of the previously tacked piling member and guides the left-hand lower edge of the hoisted piling member into the large open upper end of guide G as the hoisted piling member is lowered by hoist H. Once the lower corner of the hoisted piling member is inserted into the guide, the workman may remove his hands from the hoisted piling member and the hoisted piling member will be self-centered with respect to the interconnecting means I of the previously tacked piling member as it is lowered and as it contacts the guide surfaces 69 on the interior of the guide body. Once the lower end of the hoisted piling member reaches the level of throat 70 and once its web 11 is received in longitudinal slot 67, the interlocking means I of the two piling members are in the general axial alignment, as shown in FIG. 4B, and the hoisted piling member may be lowered thereby effecting the endwise threading of the interlocking means of the two piling members together. Once the piling member has been lowered so that its lower end is in engagement with earth E, the workman may lift the guide G upwardly to remove it from the previously tacked piling member and from the newly positioned piling member.

It will be appreciated, however, that in positioning and tacking piling members, such as shown in FIGS. 4A and 4B in which the piling members are not symmetrical about their webs, two guide members G must be utilized which are opposite hand guide members. These opposite hand guide members are essentially identical to one another, but the guide throats 70 are mirror images of one another so that the adjacent piling members P may be alternated with one another with their one faces 27 facing alternately inwardly and outwardly, as shown in FIGS. 3 and 4B.

Referring now to FIGS. 12–15, a second embodiment of the guide member of the present invention is indicated in its entirety by reference character G'. Corresponding parts to guide G' are indicated by "primed" reference characters. The primary difference between guide member G' and guide member G heretofore described is that a single guide member G' may be utilized to align all of the piling members of a shoring structure C, even when unsymmetrical, alternating piling members are used, as shown in FIG. 4B.

Figure 14:
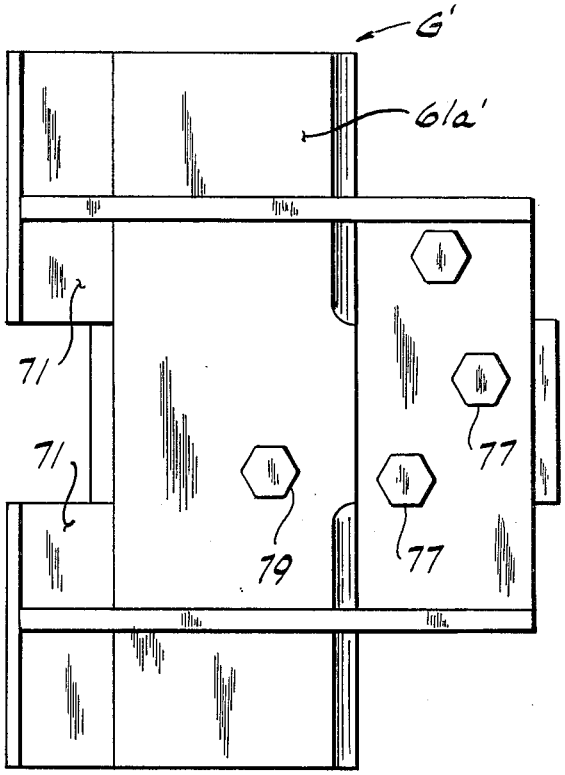
FIG. 14 is a right side elevational view of the sheet piling guide shown in FIG. 13.
Figure 15:
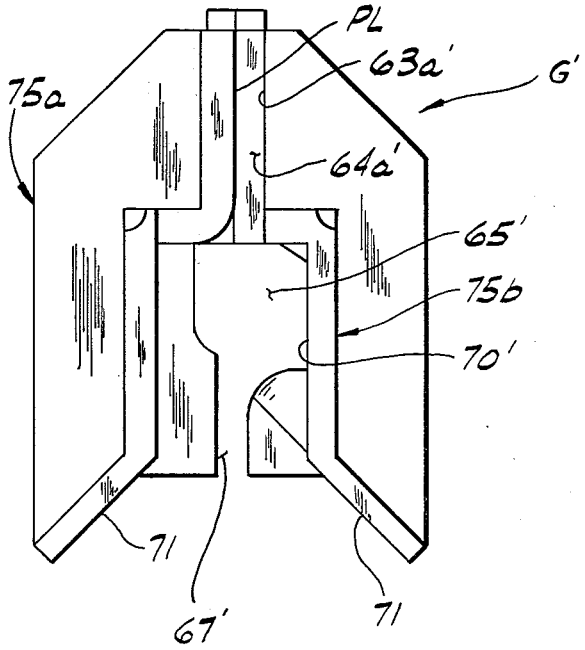
FIG. 15 is a top plan view of the sheet piling guide illustrated in FIGs. 12–14.

Specifically, guide G' has two guide body sections, as indicated at 75*a*, 75*b*, with a partline PL (see FIG. 15) indicating the interface between the guide body sections. The guide body sections are rigidly secured together by means of bolts 77 as best shown in FIG. 14. Guide G' is provided with blind slots 63*a*', 63*b*' at opposite ends thereof at one side of the guide body and have respective abutment surfaces 64*a*', 64*b*'. Further, guide G' has a longitudinal guide bore 65' extending therethrough from one end to the other of the guide body and longitudinal slot 67' (see FIG. 15) is provided extending through the guide body on the side thereof opposite from blind slot 63*a*', 63*b*'. The guide body is further provided with guide ramps 69' which taper inwardly from the open outer ends of the guide bore toward guide throat 70' (see FIG. 15) which is configured generally to receive the interconnecting means I of the piling members being positioned. Further, each of the guide body sections 75*a*, 75*b*, is provided with a clamping bolt 79 which may be selectively operated so as to clamp the guide G' to the upper end of the last-tacked piling member while the next piling member is lowered into position.

Figure 13:
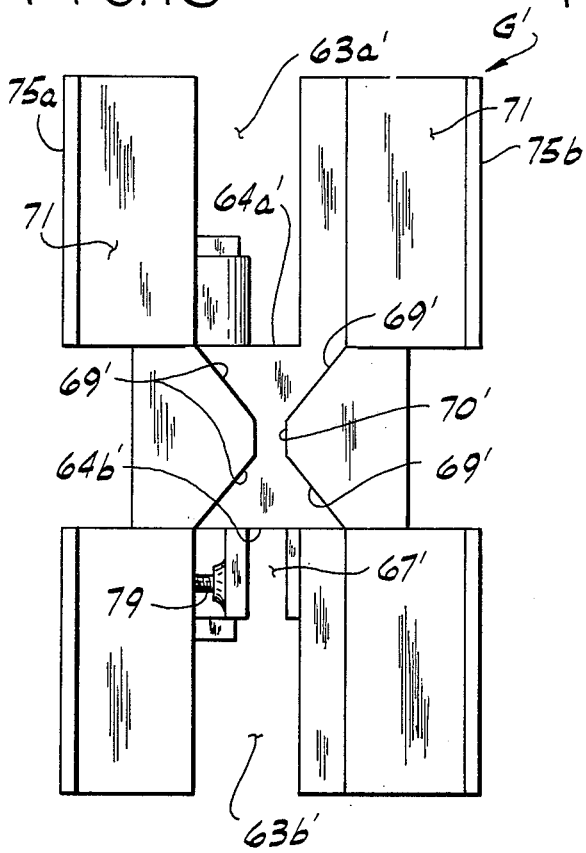
FIG. 13 is a front elevational view of the sheet piling guide illustrated in FIG. 12.

In operation, the workman utilizes guide G' in the manner heretofore described in regard to guide G, except that only a single guide is required to position alternating, unsymmetrical piling members. For example, the piling guide G' is inserted on piling member P1 (referring to FIG. 4B) in much the same manner as guide G, as illustrated in FIG. 11. After the next piling member P2 has been installed, the workman lifts the guide G' clear of the piling member P1, turns it over end-for-end, and installs it on the outer edge of the last-tacked piling member P2. It will be appreciated that the blind slots 63*a*', 63*b*' are substantially mirror (or opposite hand) images of one another (as best shown in FIG. 13) so that the throat 70' of the guide may be either a left or right-hand throat, depending on which end of the guide member is required.

Further, it will be appreciated that because guide G' is comprised of two guide body sections 75*a*, 75*b* removably secured together by means of bolts 77, the guide body sections may be readily unbolted from one another or removable from the piling members in the event that the last-tacked piling member extends appreciably above the elevation of the workman WM so that the guide G need not be threaded off the top of the last-tacked piling member. Additionally, those skilled in the art will recognize that securement means other than bolts 77, including quick release means, may be utilized to secure the guide body sections together.

The method of this invention of construction of a shoring structure C, such as described above, consists of at least partially inserting one end of a first piling member into the earth, as generally shown in FIG. 2A. Then, a workman WM is positioned on a selectively movable work platform 39 adjacent the upper end of this first piling member and the workman installs a piling guide G on the upper end of the first piling member, generally as shown in FIGS. 2A and 11. Then, a second piling member is hoisted above the guide (as shown in FIG. 2A) with the second piling member extending generally vertically, the lower end of the second piling member is guided at it is lowered into the upper open end of the guide so as to align the interlocking means I of the first and second piling members into endwise threaded engagement with one another. Then, the second piling member is lowered with respect to the first piling member. This process is repeated until a number of piling members have been interconnected. Then suitable, conventional pile driving apparatus (not shown) may be used so as to at least partially drive the interconnected members into earth E. Of course, template T and rings R may be utilized to maintain alignment of the piling members in a desired configuration while they are being tacked and fully driven to their desired depths. After construction of the shoring structure C, the work platform/hoist WP and the template T are removed from the shoring structure and the interior of the structure may be filled with sand.

In view of the above, it will be seen that the other objects of this invention are achieved and other advantageous results obtained.

As various changes could be made in the above constructions or methods without departing from the scope of the invention, it is intended that all matter contained in the above description or shown in the accompanying drawings shall be interpreted as illustrative and not in a limiting sense.

What is claimed is:

1. A system for the construction of a shoring structure having a substantially vertical wall formed of a plurality of interlocked, elongate piling members driven into the ground, each of said piling members having means along its sides for interconnection with adjacent piling members, said shoring structure being constructed by positioning at least one of said piling members generally vertically and by at least partially imbedding this one piling member into the ground, the next piling member is then hoisted above the upper end of said one vertical piling member and the interconnection means of the one piling member and the hoisted piling member are engaged and the hoisted piling member is lowered relative to said one piling member, said system comprising apparatus for supporting a workman at a desired position adjacent the upper end of said one piling member so as to enable him to guide said hoisted piling member into endwise interlocking relation with said one piling member, said workman support including a base, a spud pile adapted to be imbedded in the earth, said base being removably securable to said spud pile whereby said workman support may be readily attached to and readily removed from said spud pile, a boom coupled to the base and extending upwardly therefrom, a workman support platform carried by the outer end of said boom, said boom including means for selectively positioning said workman support platform at substantially any desired position along said partially imbedded piling members thereby to enable said workman to aid in the interconnection of said piling members.

2. A system as set forth in claim 1 wherein said boom is pivotally connected to said base for rotating about a horizontal axis and said workman support including means for raising and lowering the boom.

3. A system as set forth in claim 2 wherein said boom is a telescopic boom having at least two boom sections with said workman support platform carried on the free end of the outermost boom section, said base together with said boom being rotatable about a vertical axis whereby said work platform may be infinitely adjustable within a limited range so as to position the work platform at any desired position adjacent the upper ends of said partially imbedded piling members.

4. A system as set forth in claim 1 wherein said shoring structure is generally of circular cross-section and wherein said base is rotatable about a generally vertical axis, said vertical axis being generally concentric with said circular shoring structure.

5. A system as set forth in claim 1 further including a guide which may be fitted on to the upper edge of said one piling member adjacent the edge thereof to be interconnected with a next adjacent piling member, said guide having an open upper end for receiving a portion of the bottom of said next adjacent piling member which is hoisted above said one piling member and which is lowered into the upper open end of said guide, said guide having means therein engageable with the next adjacent piling member as it is lowered relative to said one piling member for the endwise alignment of said interconnecting means of said piling members.

6. A system as set forth in claim 5 wherein said guide has a slot in its bottom for reception of a portion of the upper edge of said one piling member, said slot cooperating with said one piling member so as to align said alignment means of said guide with the interconnection means of said one piling member.

7. A system as set forth in claim 6 wherein said alignment means further includes a longitudinal slot in said guide on the side opposite from said first-mentioned slot and a guide bore extending longitudinally through said guide, a portion of the bottom edge of the hoisted piling member being insertable into the upper open end of said guide a portion of said hoisted piling member being received in said longitudinal slot thereby to permit the hoisted piling member to be lowered relative to the guide and to said first piling member and permit the endwise interconnection of said interconnecting means.

8. A system for the construction of a shoring structure having a substantially vertical wall formed of a plurality of interlocked, elongate piling members driven into the ground, each of said piling members having means along its sides for interconnection with adjacent piling members, said shoring structure being constructed by positioning at least one of said piling members generally vertically and by at least partially imbedding this one piling member into the ground, the next piling member is then hoisted above the upper end of said one vertical piling member and the interconnection means of the one piling member and the hoisted piling member are engaged and the hoisted piling member is lowered relative to said one piling member, including a template to aid in the construction of said shoring structure, said template including one or more rings and means for supporting said rings, said piling members being positionable on said rings for vertical and circumferential alignment of said piling members relative to said template, said template having an interior structure within said rings, said system comprising apparatus for supporting a workman at a desired position adjacent the upper end of said one piling member so as to enable him to guide said hoisted piling member into endwise interlocking relation with said one piling member, said workman support including a base, a boom coupled to the base and extending upwardly therefrom, a workman support platform carried by the outer end of said boom, said boom including means for selectively positioning said workman support platform at substantially any desired position along said partially imbedded piling members thereby to enable said workman to aid in the interconnection of said piling members, said workman support being mounted on said template interior structure.

9. A guide for aiding the vertical threading of a piling member to another, previously positioned vertical piling member, each of said piling members having interlocking means along the lateral edges thereof and extending the length thereof with the interlocking means of one of the piling members being adapted to receive the interlocking means of the next adjacent piling member when the interlocking means of the piling members are endwise threaded together, said piling member being slidable lengthwise relative to one another upon threading of the interlocking means thereof together, said guide having a body with a blind slot in one side thereof extending from one end of the guide body and terminating a distance from said one end of said guide body, said blind slot being adapted to receive a portion of the upper edge of said at least partially driven piling member thereby to align said guide body with the longitudinal axis of said interlocking means of said previously positioned piling member, said guide body further having a guide opening extending therethrough, said guide body further having a slot extending longitudinally through said guide body on the side of the guide body opposite from said blind slot for providing communication between the other side of the guide body and the guide bore and for receiving a portion of the lower end of said next adjacent piling member and for aligning the interconnecting means of the next adjacent piling member to the interconnecting means of the said previously positioned piling member so that upon lowering the next piling member, the interconnecting means of said piling members will be endwise threaded together.

10. A guide for aiding the vertical endwise threading of interlocking piling members which are adapted to be driven in substantially vertical direction into the ground, each of said piling members being an elongate member having a main body section with interconnecting means at each lateral side thereof, said interconnecting means comprising means defining a groove along one side of one of said piling members and tongue means on the next adjacent piling member adopted to be received endwise in said groove so as to substantially prevent sidewise and lateral relative movement between the interlocked piling members, said guide comprising a guide body having a first end and a second end, a guide bore extending longitudinally through said guide body from one end thereof to the other, said guide body having a blind slot therein along one side thereof extending longitudinally of said guide body from said one end thereof and terminating a distance from said one end, said blind slot providing communication through said guide body from one side thereof to said guide bore, a longitudinal slot in said guide body on the side opposite thereof from said blind slot and extending longitudinally of the body from one end thereof to the other for providing communication from said other side of said guide body to said guide bore, said guide bore having guide surfaces therein, said guide body being installable on the top of a first piling member with said blind slot receiving the upper top portion of said first piling member and with said interlocking means of said first piling member being in line with said guide bore of said guide body, the lower inner edge of a next adjacent piling member being received from above in said guide bore and in said longitudinal slot with the interlocking means of said next adjacent piling member being received in said guide bore and with the main body section of said next adjacent piling member being received in said longitudinal slot and extending from the guide bore to the outside of said guide body, said guide surfaces in said guide bore being engageable with said next adjacent piling member as the latter is lowered with respect to the guide and with respect to said one piling member so as to align said interlocking of said piling members with one another thus permitting the endwise threading of the interlocking means of the piling members.

11. A guide as set forth in claim 10 wherein each said piling member has a first face and a second face, said interlocking means of each said piling member being offset from said main body section toward one face of said piling member, said first piling member being oriented such that its first face faces in a first direction, and the next said adjacent piling member interconnected to said first piling member and constituting a second piling member being oriented such that its first face faces in opposite direction relative to the first face of said first piling member, and a third piling member being threadably interconnected to said second piling member with first face of said third piling member being oriented in the same direction as the first face of said one piling member so that the body sections of said first and third piling members are substantially in line with one another, said guide body having a second blind slot therein on the same side of the guide body as said first-mentioned slot with the second blind slot extending longitudinally of the guide body from the other end thereof and terminating a distance from said other end of said guide body, said first and second blind slots permitting said guide body to be used with its first end down to thread said second piling member relative to said first piling member and to be inverted and to thread said third piling member to said second piling member.

12. A method of constructing a shoring structure, the latter being formed from a plurality of elongate piling members interlocked along their adjacent side edges and being at least partially imbedded in the ground, each of said piling members have interfitting interlock means along their side edges with the interlock means of one piling member being threadable endwise with the interlock means of the next adjacent piling member, a structure for serving as a template during construction of the shoring structure, said method comprising the steps of:

installing a selectively movable workman support means on said template support means;

at least partially inserting one end of a first piling member into the ground;

positioning a workman on said workman support means adjacent the upper end of said first piling member, said workman being positioned on a selectively movable work platform movable to substantially any desired position along the piling members being installed;

installing a piling member guide on the upper end of said first piling member;

selectively moving said work platform to a desired position so that said workman may conveniently aid in the guiding of one piling member into interlocking relation with another piling member;

hoisting a second piling member above the level of said guide with said second piling member extending vertically;

lowering said second piling member and guiding at least a portion of the lower end of said second piling member into said guide thereby to facilitate the alignment of the interlocking means of said first and second piling members into endwise threaded engagement with one another; and lowering said second piling member with respect to said first piling member.

13. The method of claim 12 further comprising the steps of:

removing the piling guide from the first piling member;

moving said work platform, if required, to a position adjacent the upper end of said second piling member;

installing said guide member on the upper end of said second piling member;

hoisting a third piling member above the level of said guide;

lowering said third piling member and inserting it into said guide for alignment of said interconnecting means; and further lowering said third piling member relative to said second piling member whereby the interlock means are endwise threaded relative to one another.

14. The method of claim 13 wherein the interlocking means of said piling members are laterally offset from a lateral central plane of the piling members, and wherein the method further consists of inserting said guide as it is moved from said first to said second piling members so that the first and third piling members are substantially in line with one another.

* * * * *